US010638909B2

(12) United States Patent
Shi et al.

(10) Patent No.: US 10,638,909 B2
(45) Date of Patent: May 5, 2020

(54) SPRAY ARM ASSEMBLY OF DISH WASHER AND DISH WASHER HAVING SAME

(71) Applicant: FOSHAN SHUNDE MIDEA WASHING APPLIANCES MFG. CO., LTD., Foshan (CN)

(72) Inventors: Yingqing Shi, Foshan (CN); Feng Gao, Foshan (CN)

( * ) Notice: Subject to any disclaimer, the term of this patent is extended or adjusted under 35 U.S.C. 154(b) by 198 days.

(21) Appl. No.: 15/566,722

(22) PCT Filed: Dec. 3, 2015

(86) PCT No.: PCT/CN2015/096346
§ 371 (c)(1),
(2) Date: Oct. 16, 2017

(87) PCT Pub. No.: WO2016/165348
PCT Pub. Date: Oct. 20, 2016

(65) Prior Publication Data

US 2018/0103825 A1 Apr. 19, 2018

(30) Foreign Application Priority Data

Apr. 14, 2015 (CN) ..... 2015 1 0176011
Apr. 14, 2015 (CN) ..... 2015 2 0223932 U

(51) Int. Cl.
*A47L 15/22* (2006.01)
*A47L 15/42* (2006.01)
*A47L 15/23* (2006.01)

(52) U.S. Cl.
CPC ..... *A47L 15/22* (2013.01); *A47L 15/23* (2013.01); *A47L 15/4282* (2013.01)

(58) Field of Classification Search
None
See application file for complete search history.

(56) References Cited

U.S. PATENT DOCUMENTS 8,578,954 B2 11/2013 Rappette
2010/0275957 A1 11/2010 Fountain et al.

FOREIGN PATENT DOCUMENTS

CN 203987928 U 12/2014
CN 204158346 U 2/2015
(Continued)

OTHER PUBLICATIONS

Patent translation provided by EPO and Google of CN203987928 translated on Jun. 25, 2019 (Year: 2014).*

*Primary Examiner* — Rita P Adhlakha
(74) *Attorney, Agent, or Firm* — Kilpatrick Townsend & Stockton, LLP

(57) ABSTRACT

Disclosed are a spray arm assembly (1) of a dish washer (100) and a dish washer (100) having same. The spray arm assembly (1) includes: a fixed gear (10), the fixed gear (10) being provided with a water inlet (101); a main spray arm (20), the main spray arm (20) being connected to the fixed gear (10) and being pivotable around a central axis of the fixed gear (10), the main spray arm (20) being internally provided with a first spray lumen (201), and the outer surface of the main spray arm (20) being provided with a thrust aperture (203) and a plurality of first spray apertures (202); a movable gear (30), the movable gear (30) being connected to the main spray arm (20), and the movable gear (30) being meshed with the fixed gear (10) so as to drive the movable gear (30) pivotably around the self-central axis and pivotably around the central axis of the fixed gear (10); and an auxiliary spray arm (40), the auxiliary spray arm (40) being connected to the movable gear (30) and moving synchronously with the movable gear (30), the auxiliary spray arm (40) being internally provided with a second spray lumen (401), and an outer circumferential surface of the
(Continued)

auxiliary spray arm (40) being provided with a plurality of second spray apertures (402).

10 Claims, 3 Drawing Sheets

(56) References Cited

FOREIGN PATENT DOCUMENTS

| | | | |
|---|---|---|---|
| CN | 104739346 | A | 7/2015 |
| CN | 204744061 | U | 11/2015 |
| EP | 1882435 | A1 | 1/2008 |
| KR | 20120134370 | A | 12/2012 |

* cited by examiner

SPRAY ARM ASSEMBLY OF DISH WASHER AND DISH WASHER HAVING SAME

CROSS-REFERENCE TO RELATED APPLICATIONS

The present application is a national phase entry under 35 USC § 371 of International Application PCT/CN2015/096346, filed Dec. 3, 2015, which claims the benefit of and priority to Chinese Patent Application No. 201510176011.X and 201520223932.2, filed Apr. 14, 2015, the entire disclosures of which are incorporated herein by reference.

FIELD

The present disclosure relates to a technical field of dishwashers, and more particularly to a spray arm assembly for a dishwasher and a dishwasher having the same.

BACKGROUND

In the related art, a dishwasher has a one-dimensional rotatable spray arm, and the spray arm sprays water out at a fixed angle, it's hard to clean dead areas in the dishwasher. In order to ensure a cleaning effect, a longer washing time is needed, but a cleaning rate is not ideal. On the other hand, the whole spray arm is configured as an integral component, or a main spray arm and an auxiliary spray arm are configured as integral components separately, so the structure is complex, when a portion or connection between two arms goes wrong, the integral component needs replacing, and the spray arm is inconvenient to manufacture and high in manufacturing and maintenance costs.

SUMMARY

The present disclosure seeks to solve at least one of the problems existing in the related art to at least some extent.

The present disclosure provides a spray arm assembly of a dishwasher, and the spray arm assembly has high manufacturability and a high cleaning effect.

The present disclosure further provides a dishwasher having the above spray arm assembly.

The spray arm assembly according to embodiments of the present disclosure, includes a fixed gear, defining a water inlet in communication with a water feeder; a main spray arm, connected to the fixed gear and pivotable about a central axis of the fixed gear, defining a first spray lumen in communication with the water inlet, and having an outer surface defining a thrust aperture and a plurality of first spray apertures both in communication with the first spray lumen; a moving gear, connected to the main spray arm, engaged with the fixed gear, and pivotable on its own central axis and about the central axis of the fixed gear; and an auxiliary spray arm, connected to the moving gear and synchronously moving along with the moving gear, defining a second spray lumen in communication with the water inlet, and having an outer circumferential surface defining a plurality of second spray apertures in communication with the second spray lumen.

With the spray arm assembly according to the embodiments of the present disclosure, the spray arm can achieve conversion from one-dimensional rotation to two-dimensional rotation, thus improving a cleaning rate. The spray arm is no longer an integrally formed member, and particularly, the auxiliary spray arm can be comprised of two separate components, thus improving manufacturability and reducing cost.

In addition the spray arm assembly according to the present disclosure further has the additional technical features as follows.

According to some embodiments of the present disclosure, the moving gear is connected to the auxiliary spray arm by means of threaded connection or snapping connection.

According to some embodiments of the present disclosure, the moving gear includes: a gear portion, engaged with the fixed gear; a first connection portion, connected to the gear portion, fitted over the main spray arm and pivotably connected to the main spray arm; and a second connection portion, connected to the first connection portion, and connected to the auxiliary spray arm by means of threaded connection or snapping connection.

According to some embodiments of the present disclosure, the main spray arm has an outer circumferential surface provided with a snap, and the first connection portion has an inner circumferential surface provided with a snap rib fitted with the snap.

According to some embodiments of the present disclosure, the main spray arm has an end extending beyond connection between the moving gear and the auxiliary spray arm, the end of the main spray arm has an outer circumferential surface provided with an anti-leakage rib, and a clearance fit is provided between the anti-leakage rib and an inner circumferential surface of the auxiliary spray arm.

According to some embodiments of the present disclosure, a plurality of anti-leakage ribs are provided, and the plurality of anti-leakage ribs are spaced apart along an axial direction of the main spray arm.

According to some embodiments of the present disclosure, the fixed gear is connected to the main spray arm via a locking piece.

According to some embodiments of the present disclosure, the main spray arm has a mounting circumferential wall protruding outwards, the fixed gear is fitted over the mounting circumferential wall with a gap therebetween, a pressing piece is connected to the mounting circumferential wall, and part of the pressing piece abuts against the fixed gear to prevent the fixed gear from falling off from the mounting circumferential wall.

According to some embodiments of the present disclosure, an anti-wear gasket is arranged between the part of the locking piece and the fixed gear.

The dishwater of the present disclosure includes the spray arm assembly of the present disclosure.

Additional aspects and advantages of embodiments of present disclosure will be given in part in the following descriptions, become apparent in part from the following descriptions, or be learned from the practice of the embodiments of the present disclosure.

Figure 1:
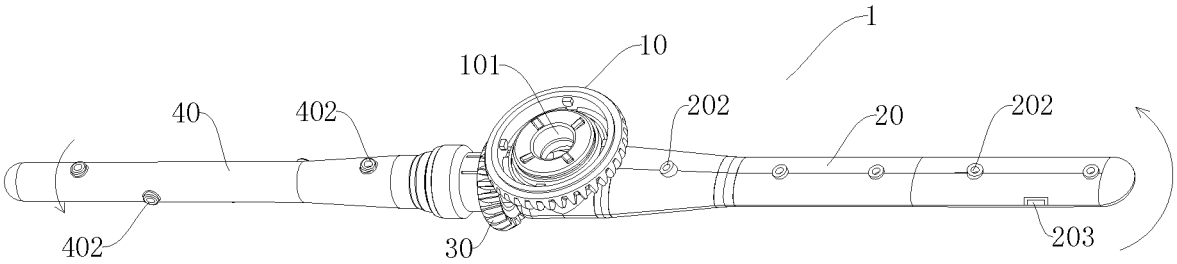
FIG. 1 is a schematic view of a spray arm assembly of a dishwasher according to an embodiment of the present disclosure.

REFERENCE NUMERALS dishwasher 100, spray arm assembly 1, water pump 2, water cup 3, internal water conduit 4, upper dish rack 5, lower dish rack 6, fixed gear 10, water inlet 101, main spray arm 20, first spray lumen 201, first spray aperture 202, thrust aperture 203, snap 21, anti-leakage rib 22, mounting circumferential wall 23, moving gear 30, gear portion 31, first connection portion 32, snap rib 321, second connection portion 33, auxiliary spray arm 40, second spray lumen 401, second spray aperture 402, locking piece 50, anti-wear gasket 60.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

With reference to drawings, a spray arm assembly 1 of a dishwasher according to embodiments of the present disclosure will be described in detail.

As illustrated in FIG. 1 to FIG. 5, the spray arm assembly 1 according to the embodiments of the present disclosure includes a fixed gear 10, a main spray arm 20, a moving gear 30 and an auxiliary spray arm 40.

The fixed gear 10 defines a water inlet 101 in communication with a water feeder. The main spray arm 20 is connected to the fixed gear 10 and pivotable about a central axis of the fixed gear 10. The main spray arm 20 defines a first spray lumen 201 in communication with the water inlet 101. An outer surface of the main spray arm 20 defines a thrust aperture 203 and a plurality of first spray apertures 202 both in communication with the first spray lumen 201.

The moving gear 30 is connected to the main spray arm 20, and under a reaction force of the water which is sprayed out through the thrust aperture 203, the moving gear 30 can rotate synchronously along with the main spray arm 20, that is, the moving gear can pivot about the central axis of the fixed gear 10. During pivoting of the moving gear, the moving gear 30 is engaged with the fixed gear 10 for transmission, such that the moving gear 30 can pivot on its own central axis. The auxiliary spray arm 40 is connected to the moving gear 30 and synchronously moves along with the moving gear 30. The auxiliary spray arm 40 internally defines a second spray lumen 401 in communication with the water inlet 101, and an outer circumferential surface of the auxiliary spray arm 40 defines a plurality of second spray apertures 402 in communication with the second spray lumen 401.

For the spray arm assembly 1 according to the embodiments of the present disclosure, the moving gear 30 is provided, engaged with the fixed gear 10 and connected to the auxiliary spray arm 40, such that the auxiliary spray arm 40 can pivot about a central axis of the main spray arm 20 and about the central axis of the fixed gear 10, that is, the auxiliary spray arm 40 can implement two-dimensional rotation. The plurality of second spray apertures 402 of the auxiliary spray arm 40 can changes their locations continuously along with the auxiliary spray arm 40, thus changing angles of spraying water continuously, avoiding dead cleaning areas, shortening the cleaning time and improving the cleaning rate. Meanwhile, the spray arm assembly is comprised of the main spray arm 20, the auxiliary spray arm 40, the moving gear 30 and other separate components, such that not only the assembling is convenient, but also manufacturing difficulty can be effectively reduced, thereby facilitating maintenance and replacement, and lowering the cost.

Figure 2:
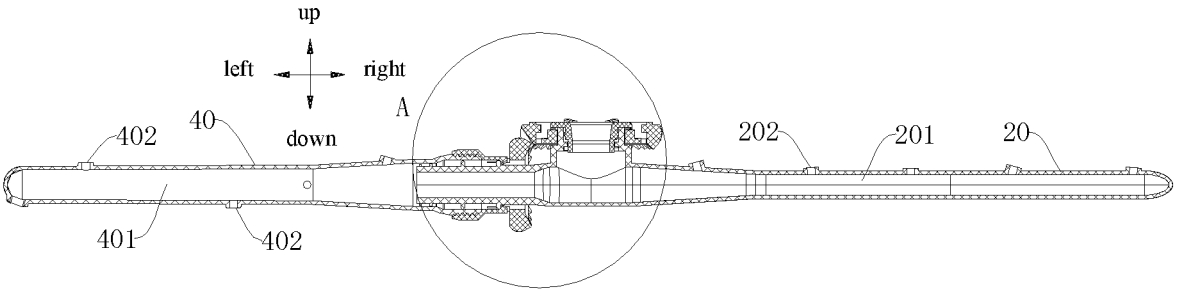
FIG. 2 is a sectional view of a spray arm assembly of a dishwasher according to an embodiment of the present disclosure.

Specifically, as illustrated in FIG. 1 and FIG. 2, the spray arm assembly 1 includes the fixed gear 10, the moving gear 30, the main spray arm 20 and the auxiliary spray arm 40. The fixed gear 10 is fixed and configured to connect and support, such that the spray arm assembly 1 is connected to other components. The auxiliary spray arm 40 is connected to the main spray arm 20 via the moving gear 30, and the main spray arm 20 can drive the moving gear 30 and the auxiliary spray arm 40 to rotate.

The moving gear 30 is engaged with the fixed gear 10, the fixed gear 10 has teeth in a circle distributed horizontally, the moving gear 30 has teeth in a circle distributed vertically, and when the moving gear 30 moves under engagement with the fixed gear 10, the moving gear 30 can rotate and revolve, that is the moving gear 30 revolves about the fixed gear 10 while rotating on its own axis. Specifically, rotation of the moving gear 30 means that the moving gear 30 pivots about the central axis of the fixed gear 10, as indicated by a left arrow in FIG. 1; revolution of the moving gear 30 means that the moving gear 30 pivots on its own central axis, as indicated by a right arrow in FIG. 1.

When the spray arm assembly 1 operates, water can be sprayed out through the thrust aperture 203 of the main spray arm 20, the main spray arm 20 can rotate about the central axis of the fixed gear 10 in a horizontal plane under the thrust of reaction force, meanwhile, the moving gear 30 is driven by the main spray arm 20 to rotate synchronously along with the main spray arm 20, and the auxiliary spray arm 40 is driven by the moving gear 30 to rotate synchronously with the main spray arm 20. The spray arm assembly comprised of the main spray arm 20, the auxiliary spray arm 40 and the moving gear 30 can rotate in the horizontal plane.

When the moving gear 30 is driven by the main spray arm 20 to move, the movement of the moving gear 30 is limited by the engagement between the moving gear 30 and the fixed gear 10, that is, the moving gear 30 pivots on its own central axis while rotating about the central axis of the fixed gear 10. Thus, the auxiliary spray arm 40 is driven by the moving gear 30 to pivot about the central axis of the moving gear 30. In such a case, the spray arm can rotate in the horizontal plane, and a portion of the spray arm can rotate in a vertical plane. The spray arm can implement two-dimensional rotation, increasing the cleaning rate.

It should be noted that, the moving gear 30 is connected to the main spray arm 20, and the auxiliary spray arm 40 is connected to the moving gear 30. The spray arm assembly is not an integral component (that is the spray arm assembly is not formed integrally), but assembled by a plurality of separate components. The main spray arm 20 is a separate component, the whole auxiliary spray arm is divided into two separate components, i.e. the auxiliary spray arm 40 and the moving gear 30.

As to a component with a simple structure and small scale, an integrally formed structure is generally superior to a split structure. However, a spray arm is generally shaped into a long strip and has a long extension size, and if the spray arm is an integral component, a mold needed during the manufacturing is large, the manufacturing difficulty is increased, defects easily occur to components, transportation is difficult and the cost is high.

When the spray arm is designed as a structure with a plurality of separate components, obviously, sizes of the plurality of separate components are smaller than the size of the whole spray arm, and particularly, the length is reduced remarkably. A size of the needed mold can be reduced accordingly, the manufacturing difficulty is reduced, manufacturing quality is improved, the transportation is convenient and the assembling is simple. Further, when a separate component is damaged, it is only necessary to replace the damaged one rather than the whole spray arm, which reduces the cost greatly. Meanwhile, it is possible to select different auxiliary spray arms 40 to cooperate with the main spray arm 20 according to needs, replacement cost of the spray arm assembly 1 is reduced, and the structure of the spray arm assembly 1 can be diversified, to satisfy more cleaning requirements and environmental conditions.

It should be noted herein that the division of the whole auxiliary spray arm into two separate components does not mean simple structural division or quantity division. The whole auxiliary spray arm is divided into two separate components, i.e. the auxiliary spray arm 40 and the moving gear 30, such that the whole auxiliary spray arm can be divided into a plurality of structural components with different functions, the auxiliary arm 40 is configured as a component for spraying water, and the moving gear is configured as a component for connecting the main spray arm 20 and the auxiliary spray arm 40 and converting movement from revolution to simultaneous revolution and rotation.

If a spraying demand changes, different auxiliary spray arms 40 can be replaced. If a demand for movement of the auxiliary spray arm 40 changes, the moving gear can be replaced accordingly. For example, another gear having a different number of teeth can be replaced, to allow the auxiliary spray arm 40 to have another rotation speed.

During operation, connections between components are easy to damage, particularly a connection configured for transmission. Regarding to the above structures, the moving gear 30 is connected to three components at the same time, i.e. the fixed gear 10, the main spray arm 20 and the auxiliary spray arm 40. The moving gear 30 is relatively susceptible to damage, so the moving gear 30 is independently manufactured as a separate component for convenient replacement, and the manufacturing is relatively easier.

In short, for the spray arm assembly 1 according to the embodiments of the present disclosure, the spray arm can achieve conversion from one-dimensional rotation to two-dimensional rotation, thus improving the cleaning rate. The spray arm is no longer an integrally formed member, and the auxiliary spray arm 40 can be comprised of two separate components, thus improving the manufacturability and reducing the cost.

Figure 3:
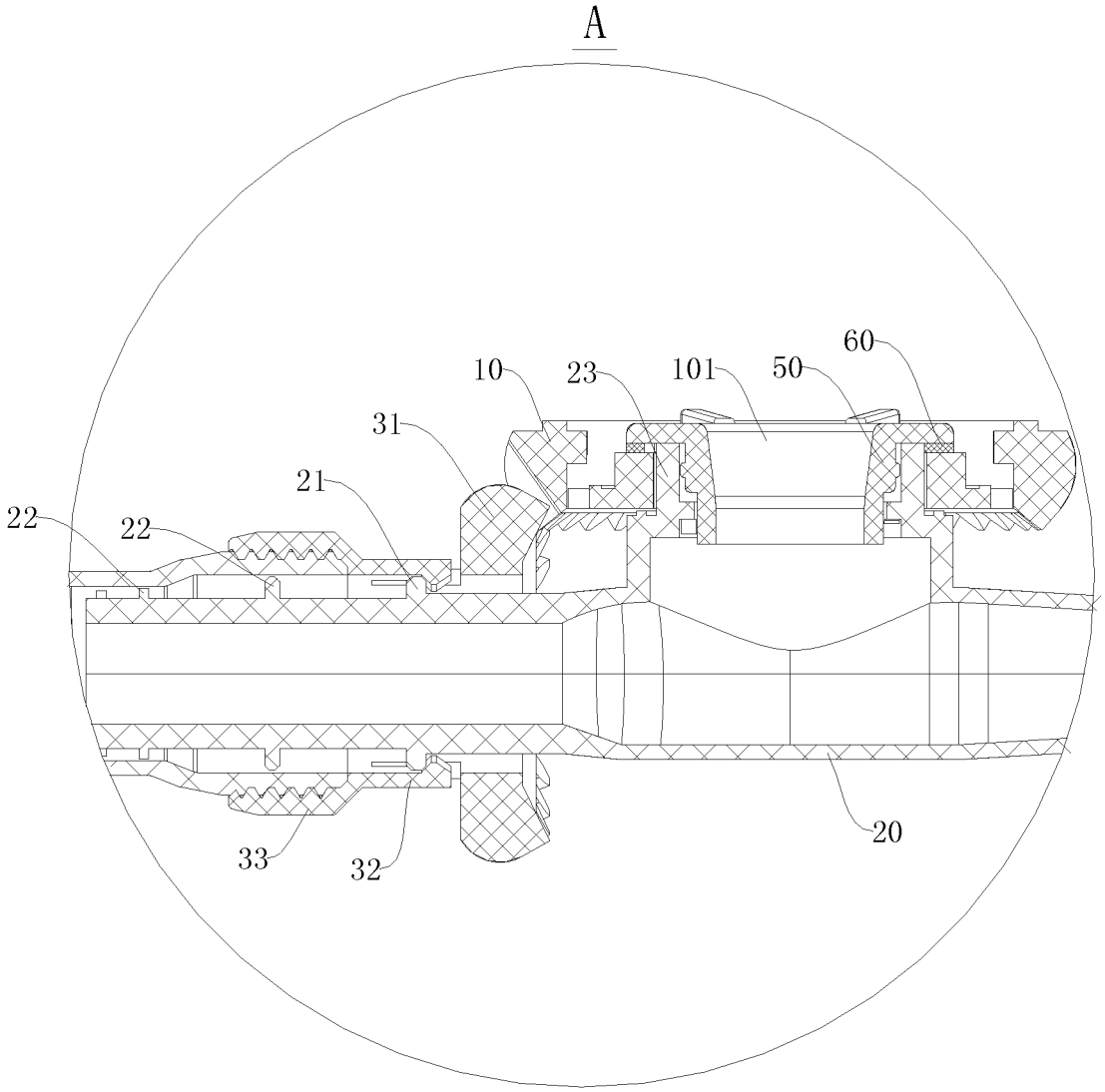
FIG. 3 is an enlarged view of part A of FIG. 2.

It should be understood that, the moving gear 30 can be connected to the auxiliary spray arm 40 in various manners. For example, FIG. 1 to FIG. 3 illustrate that the moving gear 30 can be connected to the auxiliary spray arm 40 by means of threads. Specifically, the moving gear 30 is provided with an internal thread, and the auxiliary spray arm 40 is provided with an external thread fitting with the internal thread. Of course, the moving gear 30 can also be provided with the internal thread, and the fixed gear 10 can also be provided with the external thread. For another example, in some other examples of the present disclosure, a snapping connection is provided between the moving gear 30 and the auxiliary spray arm 40.

As illustrated in FIG. 3, in some examples of the present disclosure, the moving gear 30 includes a gear portion 31, a first connection portion 32 and a second connection portion 33. The first connection portion 32 is connected to the gear portion 31, and the second connection portion 33 is connected to the first connection portion 32. In other words, the first connection portion 32 is connected between the gear portion 31 and the second connection portion 33. As illustrated in FIG. 1 to FIG. 3, the gear portion 31 is engaged with the fixed gear 10. The first connection portion 32 is fitted over the main spray arm 20 and pivotably connected to the main spray arm 20. The second connection portion 33 is connected to the auxiliary spray arm 40, specifically by means of threaded connection, snapping connection and the like.

Therefore, the gear portion 31 can function to be engaged with the fixed gear 10, the first connection portion 32 can function to be connected to the main spray arm 20, and the second connection portion 33 can function to be connected to the auxiliary spray arm 40, such that all the components have definite division of work and can be individually manufactured according to respective needs.

The second connection portion 33 can be connected to the main spray arm 20 through snapping. Specifically, a snap rib 321 is provided to an inner circumferential surface of the first connection portion 32. A snap 21 is provided to an outer circumferential surface of the main spray arm 20. When the main spray arm 20 is connected to the moving gear 30, the snap rib 321 and the snap 21 are interlocked, thus facilitating the assembling and firming the connection.

Figure 4:
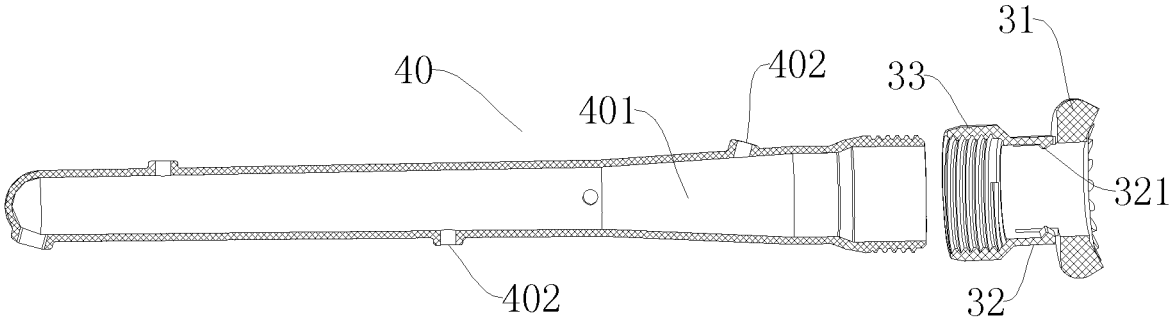
FIG. 4 is a schematic view illustrating that an auxiliary spray arm and a moving gear of a spray arm assembly of a dishwasher according to an embodiment of the present disclosure are disconnected.
Figure 5:
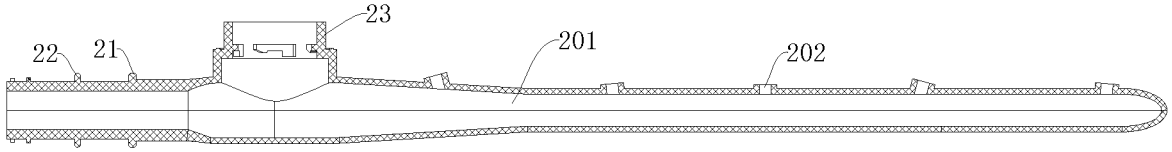
FIG. 5 is a schematic view of a main spray arm of a spray arm assembly of a dishwasher according to an embodiment of the present disclosure.

As illustrated in FIG. 4, a circle of the snap ribs 321 can be provided to the inner circumferential surface of the first connection portion 32, and configured as convex ribs extending to a central axis of the first connection portion in a radial direction of the first connection portion 32. As illustrated in FIG. 5, a circle of the snaps 21 can be provided to the outer circumferential surface of the main spray arm 20, and configured as protrusions extending away from the central axis of the main spray arm 20 in a radial direction of the main spray arm 20. Advantageously, as illustrated in FIG. 3, mating surfaces where the protrusion and the convex rib abut against with each other are configured as bevels, thus ensuring the snapping connection while reducing difficulties during assembling.

As illustrated in FIG. 2, the main spray arm 20 has an end extending beyond connection between the moving gear 30 and the auxiliary spray arm 40. Accordingly, the main spray arm 20 can reinforce the rigid of the spray arm assembly 1 at the connection between the moving gear 30 and the auxiliary spray arm 40, thus reinforcing the connection strength of the spray arm assembly 1, and hence the spray arm assembly 1 is hard to disassemble.

If gaps occur in the connection between the main spray arm 20 and the moving gear 30 and in the connection between the auxiliary spray arm 40 and the moving gear 30, water in the second spray lumen 401 easily flows out through the gaps, which causes unnecessary water leakage from the spray arm assembly 1 and weakens water spraying, thus degrading the cleaning effect. In order to reduce the water leakage from spray arm 1, an anti-leakage rib 22 is provided to an outer circumferential surface of the end of the main spray arm 20, and the anti-leakage rib 22 can extend from the outer circumferential surface of the main spray arm 20 to an inner circumferential surface of the auxiliary spray arm 40, to prevent water in the second spray lumen 401 from flowing to the gaps in the connections.

Meanwhile, considering that the moving gear 30 and the auxiliary spray arm 40 are capable of rotating relative to the main spray arm 20, the anti-leakage rib 22 should not abut against the inner circumferential surface of the auxiliary spray arm 40 for smooth rotation of the spray arm and the moving gear 30. Preferably, a clearance fit is provided between the anti-leakage rib 22 and the inner circumferential surface of the auxiliary spray arm 40, such that smooth rotation of the auxiliary spray arm 40 and the moving gear 30 are ensured while water leakage is avoided.

As illustrated in FIG. 2, the anti-leakage rib 22 and the snap rib 321 each are concentric with the auxiliary spray arm 40 and the moving gear 30, and small clearance fits are provided between the anti-leakage rib 22 and the auxiliary spray arm 40, and between the snap rib 321 and the moving gear 30, such that the auxiliary spray arm 40 can be kept horizontal, and rotational resistance is small. Moreover, two layers of anti-leakage ribs 22 can better prevent water leakage.

A plurality of anti-leakage ribs 22 can be provided, and the plurality of anti-leakage ribs 22 can be spaced apart along an axial direction of the main spray arm 20. For example, as illustrated in FIG. 2 and FIG. 5, two anti-leakage ribs 22 can be provided. The two anti-leakage ribs 22 can construct two-layer protection to prevent water leakage better, and at the same time, the auxiliary spray arm 40 can smoothly rotate under low rotation resistance.

According to some embodiments of the present disclosure, the fixed gear 10 is connected to the main spray arm 20 via a locking piece 50. In other words, the locking piece 50 is configured to mount the main spray arm 20 to the fixed gear 10. Specifically, the main spray arm 20 has a mounting circumferential wall 23 protruding outwards, and the fixed gear 10 is fitted over the mounting circumferential wall 23 with a gap therebetween, to ensure that the moving gear 30 can pivot relative to the fixed gear 10. The mounting circumferential wall 23 is configured as a hollow cylinder with two open ends, one end is connected to the first spray lumen 201, and the other end is in communication with the water feeder.

The locking piece 50 is connected to the mounting circumferential wall 23, and when the main spray arm 20 pivots, the mounting circumferential wall 23 rotates to drive the locking piece 50 to pivot relative to the fixed gear 10. Part of the locking piece 50 abuts against the fixed gear 10 to prevent the fixed gear 10 from moving up and then falling off from an upper end of the mounting circumferential wall 23. Preferably, an anti-wear gasket 60 can be arranged between the locking piece 50 and the fixed gear 10. The anti-wear gasket 60 can reduce friction between the locking piece 50 and the fixed gear 10.

To sum up, with the spray arm assembly 1 according to embodiments of the present disclosure, water is sprayed out through the thrust aperture 203 of the main spray arm 20, the reaction force pushes the main spray arm 20 to rotate in the horizontal plane and provides a power for the second-dimension rotation of the moving gear 30, such that the spray arm can implement two-dimensional rotation, thus improving the cleaning rate. The whole spray arm is divided into a plurality of separate components, and particularly, the whole auxiliary spray arm is designed to have the auxiliary spray arm 40 and the moving gear 30, achieving high manufacturability. Further, the anti-leakage rib 22 can prevent water leakage better.

Figure 6:
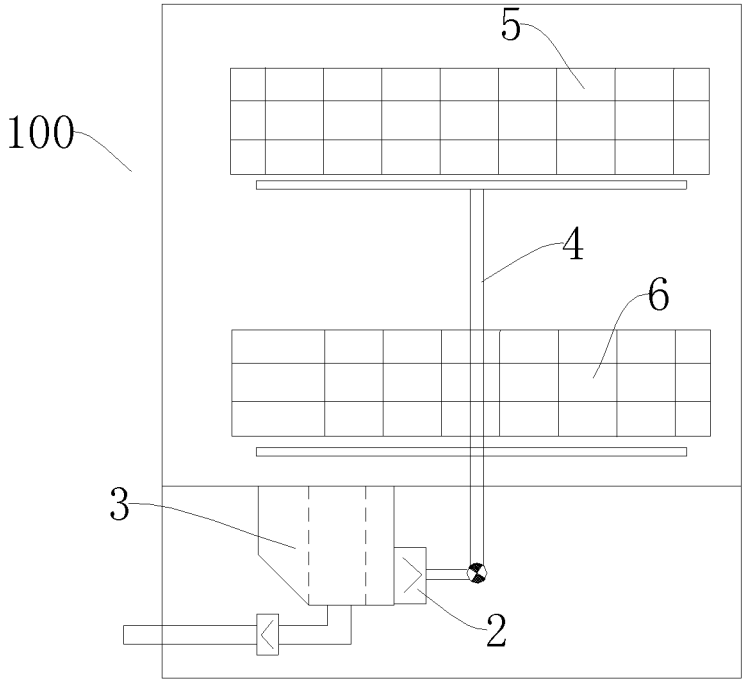
FIG. 6 is a schematic view of a dishwasher according to an embodiment of the present disclosure.

As illustrated in FIG. 6, a dishwasher 100 according to embodiments of the present disclosure includes a water pump 2, a water cup 3, an internal water conduit 4, an upper dish rack 5, a lower dish rack 6 and a spray arm assembly 11 according to the above embodiments. The water cup stores water 3 is stored with water, the spray arm assembly 11 is connected to the water cup 3 by the internal water conduit 4, and the water pump 2 is connected between the water cup 3 and the internal water conduit 4 to make the water in the water cup 3 flow into the internal water conduit 4 continuously. The internal water conduit 4 has a water outlet connected to the water inlet 101 of the spray arm assembly 11. Water can be sprayed out through the first spray aperture 202 and the second spray aperture 402 to the upper dish rack 5 and the lower dish rack 6, to wash dishes in the upper dish rack 5 and the lower dish rack 6.

Because the spray arm assembly 11 according to the embodiments of the present disclosure has the above technical effects, the dishwasher 100 according to the embodiments of the present disclosure has the high manufacturability and high cleaning rate.

Other configurations and operations of the dishwasher 100 according to the embodiments of the present disclosure are known to those skilled in the art and are not described in detail herein.

In the specification, it is to be understood that terms such as "length," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, the term "a plurality of" means two or more than two, unless specified otherwise.

Reference throughout this specification to "an embodiment," "some embodiments," "a example," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Those skilled in the art can combine or composite features in different embodiments or examples described in the specification without contradiction.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A spray arm assembly of a dishwasher, comprising:

a fixed gear, including a water inlet in communication with a water feeder;

a main spray arm, connected to the fixed gear and pivotable about a central axis of the fixed gear, including a first spray lumen in communication with the water inlet, and having an outer surface including a thrust aperture and a plurality of first spray apertures both in communication with the first spray lumen, wherein the thrust aperture is in horizontal direction, and the plurality of first spray apertures are in upward direction;

a movable gear, connected to the main spray arm, engaged with the fixed gear, and pivotable on its own central axis and about the central axis of the fixed gear; and an auxiliary spray arm, connected to the movable gear and synchronously moving along with the movable gear, including a second spray lumen in communication with the water inlet, and having an outer circumferential surface including a plurality of second spray apertures in communication with the second spray lumen;

wherein the movable gear is configured to have different numbers of gear teeth to allow the auxiliary spray arm to rotate in different rotation speed.

2. The spray arm assembly according to claim 1, wherein the movable gear is connected to the auxiliary spray arm by means of a threaded connection or a snapping connection.

3. The spray arm assembly according to claim 2, wherein the movable gear comprises:

a gear portion, engaged with the fixed gear;

a first connection portion, connected to the gear portion, fitted over the main spray arm and pivotably connected to the main spray arm; and a second connection portion, connected to the first connection portion, and connected to the auxiliary spray arm by means of the threaded connection or the snapping connection.

4. The spray arm assembly according to claim 3, wherein the main spray arm has an outer circumferential surface provided with a snap, and the first connection portion has an inner circumferential surface provided with a snap rib fitted with the snap.

5. The spray arm assembly according to claim 1, wherein the main spray arm has an end extending beyond connection between the movable gear and the auxiliary spray arm, the end of the main spray arm has an outer circumferential surface provided with an anti-leakage rib, and a clearance fit is provided between the anti-leakage rib and an inner circumferential surface of the auxiliary spray arm.

6. The spray arm assembly according to claim 5, wherein a plurality of anti-leakage ribs are provided, and the plurality of anti-leakage ribs are spaced apart along an axial direction of the main spray arm.

7. The spray arm assembly according to claim 1, wherein the fixed gear is connected to the main spray arm via a locking piece.

8. The spray arm assembly according to claim 7, wherein the main spray arm has a mounting circumferential wall protruding outwards, the fixed gear is fitted over the mounting circumferential wall with a gap there between, a pressing piece is connected to the mounting circumferential wall, and part of the pressing piece abuts against the fixed gear to prevent the fixed gear from falling off from the mounting circumferential wall.

9. The spray arm assembly according to claim 8, wherein an anti-wear gasket is arranged between the part of the locking piece and the fixed gear.

10. A dishwater, comprising:

a spray arm assembly, wherein the spray arm assembly comprises:

a fixed gear, including a water inlet in communication with a water feeder;

a main spray arm, connected to the fixed gear and pivotable about a central axis of the fixed gear, including a first spray lumen in communication with the water inlet, and having an outer surface including a thrust aperture and a plurality of first spray apertures both in communication with the first spray lumen, wherein the thrust aperture is in horizontal direction, and the plurality of first spray apertures are in upward direction;

a movable gear, connected to the main spray arm, engaged with the fixed gear, and pivotable on its own central axis and about the central axis of the fixed gear; and an auxiliary spray arm, connected to the movable gear and synchronously moving along with the movable gear, including a second spray lumen in communication with the water inlet, and having an outer circumferential surface including a plurality of second spray apertures in communication with the second spray lumen;

wherein the movable gear is configured to have different numbers of gear teeth to allow the auxiliary spray arm to rotate in different rotation speed.

* * * * *